US010804593B2

(12) United States Patent
Chang et al.

(10) Patent No.: US 10,804,593 B2
(45) Date of Patent: Oct. 13, 2020

(54) MOBILE DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 41 days.

(21) Appl. No.: 16/360,567

(22) Filed: Mar. 21, 2019

(65) Prior Publication Data

US 2020/0076049 A1 Mar. 5, 2020

(30) Foreign Application Priority Data

Sep. 3, 2018 (TW) ..... 107130820 A

(51) Int. Cl.
*H01Q 1/22* (2006.01)
*H01Q 19/24* (2006.01)
*H01Q 5/378* (2015.01)

(52) U.S. Cl.
CPC ..... *H01Q 1/2266* (2013.01); *H01Q 5/378* (2015.01); *H01Q 19/24* (2013.01)

(58) Field of Classification Search
CPC ..... H01Q 1/22; H01Q 5/37; H01Q 19/24
USPC ..... 343/702
See application file for complete search history.

(56) References Cited

U.S. PATENT DOCUMENTS

2007/0188383 A1* 8/2007 Onaka ..... H01Q 1/243 343/700 MS
2013/0176180 A1* 7/2013 Wakui ..... H01Q 9/36 343/702
2017/0237151 A1* 8/2017 Andujar Linares .... H01Q 1/243 343/702

* cited by examiner

*Primary Examiner* — Andrea Lindgren Baltzell
(74) *Attorney, Agent, or Firm* — McClure, Qualey & Rodack, LLP

(57) ABSTRACT

A mobile device includes a body, an antenna structure, and a floating radiation element. The body includes a frame and a housing. The frame is positioned on a first plane. The housing includes a parallel region and a cutting retraction region. The parallel region is positioned on a second plane which is parallel to the first plane. The floating radiation element is adjacent to the antenna structure, and is configured to enhance the radiation efficiency of the antenna structure. The antenna structure has a first vertical projection on the housing, and the first vertical projection is inside the parallel region. The floating radiation element has a second vertical projection on the housing, and the second vertical projection is inside the cutting retraction region. The frame is at least partially made of a nonconductive material. The housing is at least partially made of a conductive material.

20 Claims, 5 Drawing Sheets

MOBILE DEVICE

CROSS REFERENCE TO RELATED APPLICATIONS

This Application claims priority of Taiwan Patent Application No. 107130820 filed on Sep. 3, 2018, the entirety of which is incorporated by reference herein.

BACKGROUND OF THE INVENTION

Field of the Invention

The disclosure relates in general to a mobile device, and in particular to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna element is an essential component of a mobile device for wireless communication. However, antenna elements tend to be affected by nearby metal components, which often interfere with the antenna element and result in poor communication quality. As a result, there is a need to propose a novel solution for solving the problems of the prior art.

BRIEF SUMMARY OF THE INVENTION

In a preferred embodiment, the invention is directed to a mobile device including a body, an antenna structure, and a floating radiation element. The body includes a frame and a housing. The frame is positioned on a first plane. The housing includes a parallel region and a cutting retraction region. The parallel region is positioned on a second plane. The second plane is parallel to the first plane. The antenna structure includes a feeding connection element, a first radiation element, a second radiation element, and a shorting element. The feeding connection element is coupled to a signal source. The first radiation element is coupled to the feeding connection element. The second radiation element is coupled to the feeding connection element. The first radiation element and the second radiation element substantially extend in opposite directions. The feeding connection element is coupled through the shorting element to a ground voltage. The floating radiation element is adjacent to the first radiation element and the second radiation element, and is configured to enhance the radiation efficiency of the antenna structure. The frame is at least partially made of a nonconductive material. The housing is at least partially made of a conductive material. The antenna structure has a first vertical projection on the housing, and the first vertical projection is inside the parallel region. The floating radiation element has a second vertical projection on the housing, and the second vertical projection is inside the cutting retraction region.

In some embodiments, the housing has a structural bending portion, and the structural bending portion of the housing is positioned between the parallel region and the cutting retraction region, such that the parallel region and the cutting retraction region have different extending planes.

In some embodiments, a first average distance is defined between the frame and the parallel region, and a second average distance is defined between the frame and the cutting retraction region. The second average distance is shorter than the first average distance.

In some embodiments, a first coupling gap is formed between the floating radiation element and the first radiation element, and a second coupling gap is formed between the floating radiation element and the second radiation element. The width of the first coupling gap is from 0.1 mm to 1 mm. The width of the second coupling gap is from 0.1 mm to 1 mm.

In some embodiments, the width of the floating radiation element is from 2 mm to 3 mm.

In some embodiments, the antenna structure covers a first frequency band from 2400 MHz to 2500 MHz, and a second frequency band from 5150 MHz to 5850 MHz.

In some embodiments, the total length of the feeding connection element and the first radiation element is shorter than or equal to 0.25 wavelength of the first frequency band.

In some embodiments, the total length of the feeding connection element and the second radiation element is shorter than or equal to 0.25 wavelength of the second frequency band.

In some embodiments, the length of the shorting element is substantially equal to the length of the second radiation element.

In some embodiments, the length of the floating radiation element is substantially equal to a sum of a half of the length of the first radiation element and the length of the second radiation element.

In another preferred embodiment, the invention is directed to a mobile device including a body, an antenna structure, and a floating radiation element. The body includes a frame and a housing. The frame is positioned on a first plane. The housing includes a parallel region and a cutting retraction region. The parallel region is positioned on a second plane. The second plane is parallel to the first plane. The floating radiation element is adjacent to the antenna structure, and is configured to enhance the radiation efficiency of the antenna structure. The frame is at least partially made of a nonconductive material. The housing is at least partially made of a conductive material. The antenna structure has a first vertical projection on the housing, and the first vertical projection is inside the parallel region. The floating radiation element has a second vertical projection on the housing, and the second vertical projection is inside the cutting retraction region.

In some embodiments, the antenna structure includes a feeding connection element, a first radiation element, a second radiation element, and a shorting element. The feeding connection element is coupled to a signal source. The first radiation element is coupled to the feeding connection element. The second radiation element is coupled to the feeding connection element. The first radiation element and the second radiation element substantially extend in opposite directions. The feeding connection element is coupled through the shorting element to a ground voltage.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
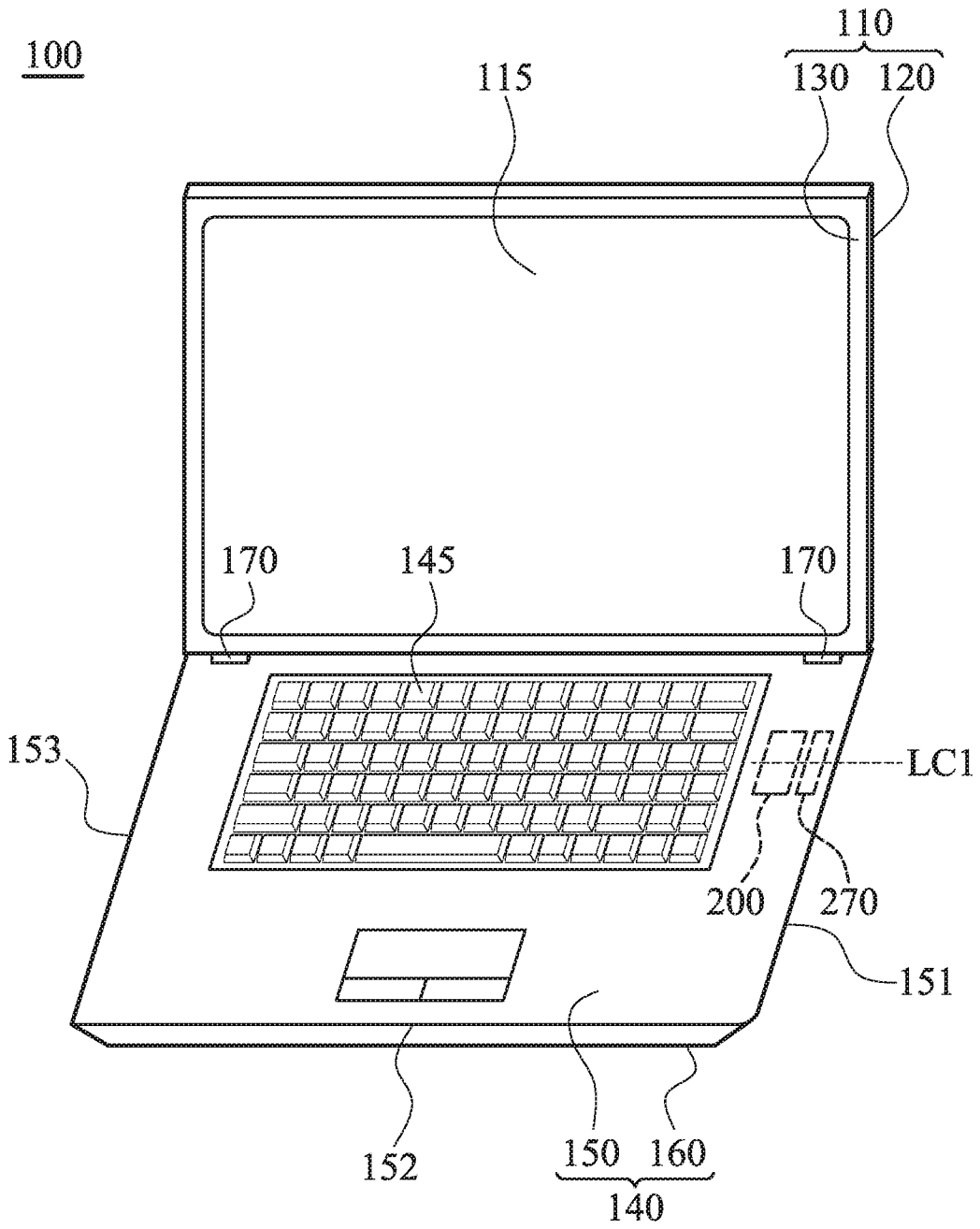
FIG. 1A is a perspective view of a mobile device according to an embodiment of the invention.
Figure 2:
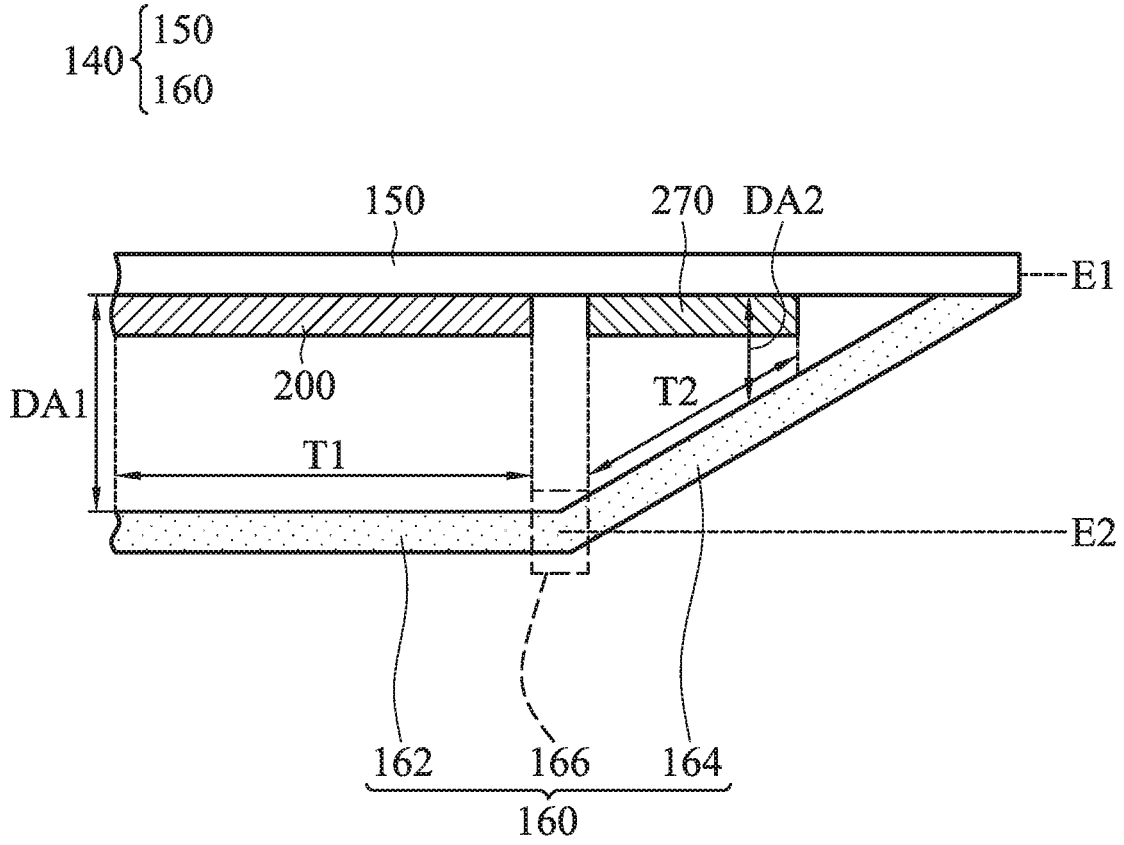
FIG. 2 is a partial sectional view of a mobile device according to an embodiment of the invention.

FIG. 1A is a perspective view of a mobile device 100 according to an embodiment of the invention. FIG. 2 is a partial sectional view of the mobile device 100 according to an embodiment of the invention (along a sectional line LC1 of FIG. 1A). The mobile device 100 may be a notebook computer. As shown in FIGS. 1A and 2, the mobile device 100 includes an upper cover 110, a body 140, a hinge element 170, an antenna structure 200, and a floating radiation element 270. It should be noted that the mobile device 100 may further include other components, such as a touch control panel, a processor, a battery module, and an input/output device although they are not displayed in FIG. 1A and FIG. 2.

The upper cover 110 may include an upper cover housing 120 and a display frame 130 which is opposite to the upper cover housing 120. A display device 115 may be embedded in the display frame 130. The body 140 includes a frame 150 and a housing 160 which is opposite to the frame 150. For example, the frame 150 may be a keyboard frame, and a keyboard 145 may be embedded in the keyboard frame 150. It should be understood that the upper cover housing 120, the display frame 130, the frame 150, and the housing 160 are considered as the so-called "A-component", "B-component", "C-component", and "D-component" of the notebook computer, respectively. The hinge element 170 is connected between the upper cover 110 and the body 140. By using the hinge element 170, the mobile device 100 can flip over to operate in either an open mode or a closed mode.

The frame 150 is at least partially or completely made of a nonconductive material, such as a plastic material. The housing 160 is at least partially or completely made of a conductive material, such as a metal material. The frame 150 is considered as an antenna window of the antenna structure 200, and the electromagnetic waves of the antenna structure 200 are transmitted through the frame 150. As shown in FIG. 2, the housing 160 includes a parallel region 162 and a cutting retraction region 164. The parallel region 162 may be substantially parallel to the frame 150. A side of the cutting retraction region 164 may be connected to the parallel region 162, and another side of the cutting retraction region 164 may be connected to an edge of the frame 150. Specifically, the housing 160 has a structural bending portion 166, and the structural bending portion 166 is positioned between the parallel region 162 and the cutting retraction region 164, such that the parallel region 162 and the cutting retraction region 164 have different extending planes. A first average distance DA1 is defined between the frame 150 and the parallel region 162. A second average distance DA2 is defined between the frame 150 and the cutting retraction region 164. The second average distance DA2 is shorter than the first average distance DA1. For example, the second average distance DA2 may be substantially equal to a half of the first average distance DA1. In some embodiments, the frame 150 is positioned on a first plane E1, and the parallel region 162 of the housing 160 is positioned on a second plane E2 which is parallel to the first plane E1.

Figure 1B:
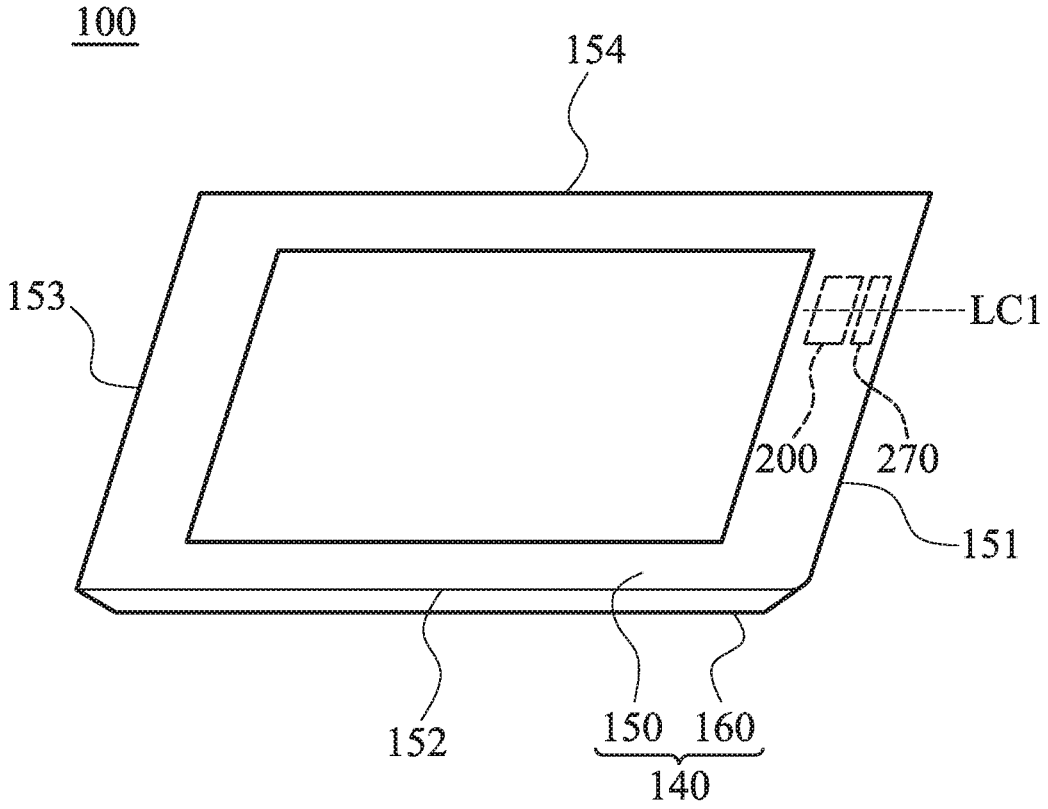
FIG. 1B is a perspective view of a mobile device according to another embodiment of the invention.

FIG. 1B is a perspective view of a mobile device 100 according to another embodiment of the invention. In the embodiment of FIG. 1B, the mobile device 100 is a smartphone or a tablet computer, and the mobile device 100 does not include the upper cover 110, the hinge element 170, the keyboard 145, and their relative components shown in FIG. 1A.

Figure 3:
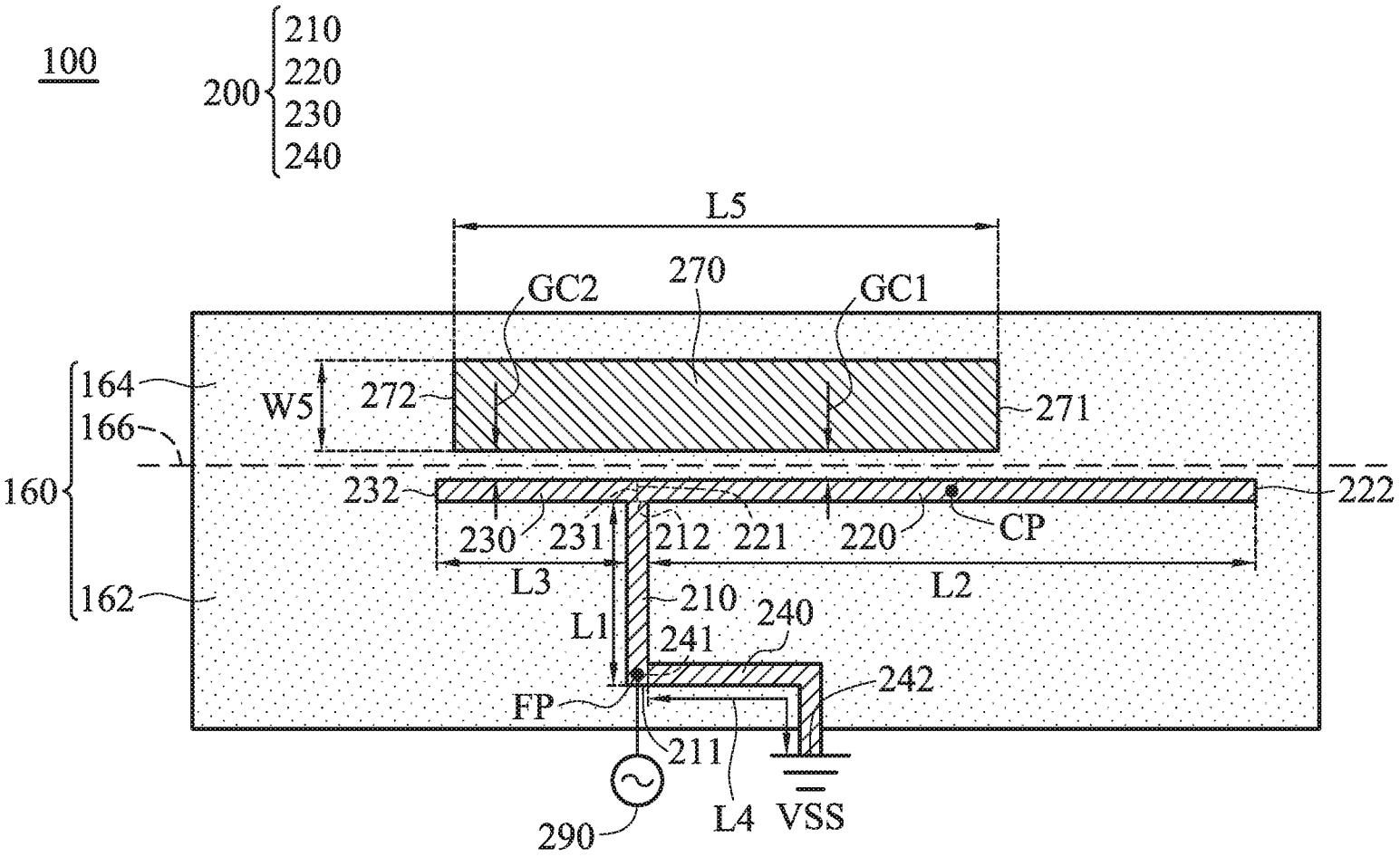
FIG. 3 is a partial top view of a mobile device according to an embodiment of the invention.

FIG. 3 is a partial top view of the mobile device 100 according to an embodiment of the invention. The frame 150 is temporarily removed from FIG. 3 and therefore the readers can understand the invention easily. Please refer to FIG. 2 and FIG. 3 together. The antenna structure 200 is disposed between the frame 150 and the housing 160. The antenna structure 200 includes a feeding connection element 210, a first radiation element 220, a second radiation element 230, and a shorting element 240. The feeding connection element 210, the first radiation element 220, the second radiation element 230, the shorting element 240, and the floating radiation element 270 are all made of conductive materials, such as metal materials. The antenna structure 200 and the floating radiation element 270 may be disposed on a dielectric substrate (not shown), such as an FR4 (Flame Retardant 4) substrate, a PCB (Printed Circuit Board), or an FCB (Flexible Circuit Board). The floating radiation element 270 is completely separate from the antenna structure 200. The floating radiation element 270 is adjacent to the first radiation element 220 and the second radiation element 230. It should be noted that the term "adjacent" or "close" over the disclosure means that the distance (spacing) between two corresponding elements is smaller than a predetermined distance (e.g., 5 mm or the shorter). The floating radiation element 270 is configured to enhance the radiation efficiency of the antenna structure 200. As shown in FIG. 2, the antenna structure 200 has a first vertical projection T1 on the housing 160, and the whole first vertical projection T1 is inside the parallel region 162; the floating radiation element 270 has a second vertical projection T2 on the housing 160, and the whole second vertical projection T2 is inside the cutting retraction region 164. That is, the structural bending portion 166 of the housing 160 can completely separate the first vertical projection T1 from the second vertical projection T2.

The feeding connection element 210 may substantially have a straight-line shape. The feeding connection element 210 has a first end 211 and a second end 212. A feeding point FP is positioned at the first end 211 of the feeding connection element 210. The feeding point FP can be coupled to a signal source 290. For example, the signal source 290 may be an RF (Radio Frequency) module for exciting the antenna structure 200.

The first radiation element 220 may substantially have a straight-line shape. The first radiation element 220 may be substantially perpendicular to the feeding connection element 210. The first radiation element 220 has a first end 221 and a second end 222. The first end 221 of the first radiation element 220 is coupled to the second end 212 of the feeding connection element 210. The second end 222 of the first radiation element 220 is an open end.

The second radiation element 230 may substantially have a straight-line shape. The second radiation element 230 may be substantially perpendicular to the feeding connection element 210. The second radiation element 230 has a first end 231 and a second end 232. The first end 231 of the second radiation element 230 is coupled to the second end 212 of the feeding connection element 210. The second end 232 of the second radiation element 230 is an open end. The second end 222 of the first radiation element 220 and the second end 232 of the second radiation element 230 substantially extend in opposite directions.

The shorting element 240 may substantially have an L-shape. A portion of the shorting element 240 may be substantially parallel to the feeding connection element 210, and another portion of the shorting element 240 may be substantially perpendicular to the feeding connection element 210. The shorting element 240 has a first end 241 and a second end 242. The first end 241 of the shorting element 240 is coupled to the first end 211 of the feeding connection element 210. The second end 242 of the shorting element 240 is coupled to a ground voltage VSS (e.g., 0V). Thus, the feeding connection element 210 is coupled through the shorting element 240 to the ground voltage VSS. The ground voltage VSS may be provided by a system ground plane (not shown) of the mobile device 100.

The floating radiation element 270 may substantially have a rectangular shape. The floating radiation element 270 may be substantially parallel to both the first radiation element 220 and the second radiation element 230. Specifically, a first coupling gap GC1 may be formed between the floating radiation element 270 and the first radiation element 220, and a second coupling gap GC2 may be formed between the floating radiation element 270 and the second radiation element 230. The floating radiation element 270 has a first end 271 and a second end 272. The first end 271 of the floating radiation element 270 may be substantially aligned with a central point CP of the first radiation element 220. The second end 272 of the floating radiation element 270 may be substantially aligned with the second end 232 of the second radiation element 230.

According to practical measurement, the antenna structure 200 can cover a first frequency band FB1 and a second frequency band FB2. The first frequency band FB1 may be from about 2400 MHz to about 2500 MHz. The second frequency band FB2 may be from about 5150 MHz to about 5850 MHz. Therefore, the antenna structure 200 can support at least the wideband operations of Bluetooth and WLAN (Wireless Local Area Network) 2.4 GHz/5 GHz. It should be noted that the above frequency ranges are adjustable according to different requirements. In alternative embodiments, the antenna structure 200 can cover a GPS (Global Positioning System) frequency band or an LTE (Long Term Evolution) frequency band, but it is not limited thereto.

With respect to the antenna theory, the feeding connection element 210 and the first radiation element 220 are excited to generate the aforementioned first frequency band FB1, and the feeding connection element 210 and the second radiation element 230 are excited to generate the aforementioned second frequency band FB2. The shorting element 240 is configured to fine-tune the impedance matching of the antenna structure 200. The floating radiation element 270 is excited by both the first radiation element 220 and the second radiation element 230 using a coupling mechanism.

Figure 4:
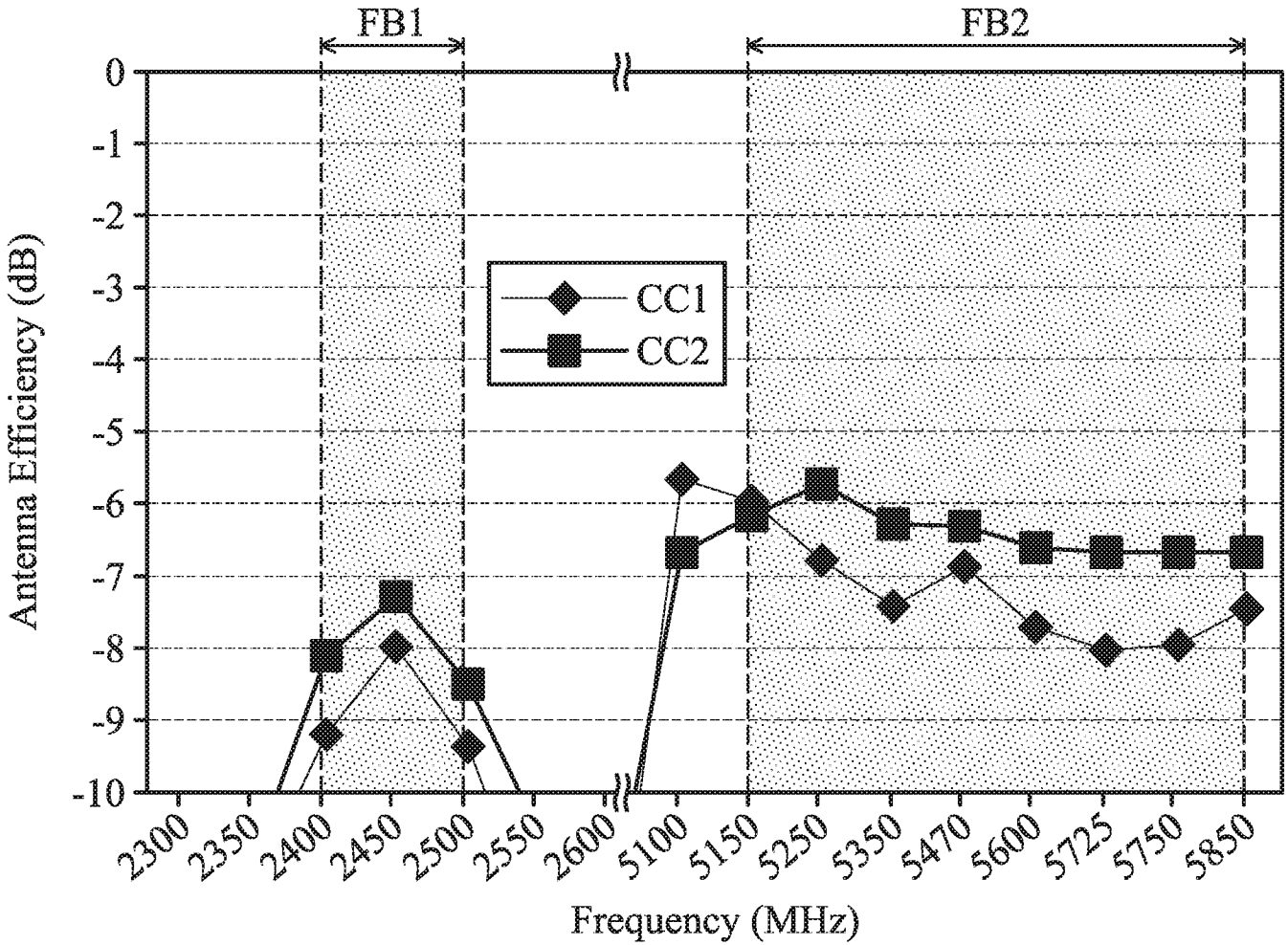
FIG. 4 is a diagram of radiation efficiency of an antenna structure of a mobile device according to an embodiment of the invention.

FIG. 4 is a diagram of radiation efficiency of the antenna structure 200 of the mobile device 100 according to an embodiment of the invention. The horizontal axis represents the operation frequency (MHz), and the vertical axis represents the antenna efficiency (dB). As shown in FIG. 4, a first curve CC1 represents the radiation efficiency of the antenna structure 200 when the floating radiation element 270 is omitted, and a second curve CC2 represents the radiation efficiency of the antenna structure 200 when the floating radiation element 270 is added to the antenna structure 200. It should be noted that in the conventional design, since the second average distance DA2 is too short, the cutting retraction region 164 of the housing 160 tends to interfere with the radiation pattern of the antenna structure 200, thereby degrading the communication quality of the mobile device 100. In order to solve the problem of the prior art, the invention adds a floating radiation element 270 above the cutting retraction region 164 of the housing 160, and the floating radiation element 270 is excited by the antenna structure 200 using a coupling mechanism. Such a design not only effectively uses the space around the cutting retraction region 164 but also enhances the radiation gain and radiation efficiency of the antenna structure 200. According to the measurement of FIG. 4, after the floating radiation element 270 is added to the mobile device 100, the radiation efficiency of the antenna structure 200 is improved by about 0.5 dB to 1 dB in the first frequency band FB1, and the radiation efficiency of the antenna structure 200 is improved by more than 1 dB in the second frequency band FB2. It can meet the requirements of practical application of general mobile communication devices.

Please refer to FIG. 1A again. In the embodiment of FIG. 1A, the antenna structure 200 and the floating radiation element 270 is adjacent to a first edge 151 of the frame 150; however, the invention is not limited thereto. In alternative embodiments, adjustment are made such that the antenna structure 200 and the floating radiation element 270 are adjacent to a second edge 152 or a third edge 153 of the frame 150, so as to fit a variety of cutting retraction designs of the housing 160. Similarly, in the embodiment of FIG. 1B, adjustment are made such that the antenna structure 200 and the floating radiation element 270 are adjacent to the second edge 152, the third edge 153, or a fourth edge 154 of the frame 150.

In some embodiments, the element sizes of the mobile device 100 and the antenna structure 200 are as follows. The sum (L1+L2) of the length L1 of the feeding connection element 210 and the length L2 of the first radiation element 220 may be shorter than or equal to 0.25 wavelength (λ/4)

of the central frequency of the first frequency band FB1. The sum (L1+L3) of the length L1 of the feeding connection element 210 and the length L3 of the second radiation element 230 may be shorter than or equal to 0.25 wavelength (λ/4) of the central frequency of the second frequency band FB2. The length L2 of the first radiation element 220 may be longer than or equal to three times the length L3 of the second radiation element 230 (L2≥3·L3). The length L4 of the shorting element 240 may be substantially equal to the length L3 of the second radiation element 230. For example, the length L3 of the second radiation element 230 may be from 1 mm to 3 mm, and the length L4 of the shorting element 240 may also be from 1 mm to 3 mm. The length L5 of the floating radiation element 270 may be substantially equal to the sum (L5=0.5·L2+L3) of a half of the length L2 of the first radiation element 220 and the length L3 of the second radiation element 230. The width W5 of the floating radiation element 270 may be from about 2 mm to about 3 mm. The width of the first coupling gap GC1 may be from about 0.1 mm to about 1 mm. The width of the second coupling gap GC2 may be from about 0.1 mm to about 1 mm. The above ranges of elements are calculated and obtained according to many experiment results, and they help to optimize the operation bandwidth and the impedance matching of the antenna structure 200 of the mobile device 100.

The invention proposes a novel mobile device and a novel antenna structure. By applying a floating radiation element to the cutting retraction region of the housing, the radiation efficiency and the radiation gain of the antenna structure can be effectively improved. In comparison to the conventional design, the invention has at least the advantages of small size, wide bandwidth, high frequency, and low cost, and it is suitable for application in a variety of mobile communication devices.

Note that the above element sizes, element shapes, and frequency ranges are not limitations of the invention. A designer can fine-tune these settings or values according to different requirements. It should be understood that the mobile device and antenna structure of the invention are not limited to the configurations of FIGS. 1-4. The invention may include any one or more features of any one or more embodiments of FIGS. 1-4. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. A mobile device, comprising:

a body, comprising a frame and a housing, wherein the frame is positioned on a first plane, the housing comprises a parallel region and a cutting retraction region, the parallel region is positioned on a second plane, and the second plane is parallel to the first plane;

an antenna structure, comprising:

a feeding connection element, coupled to a signal source;

a first radiation element, coupled to the feeding connection element;

a second radiation element, coupled to the feeding connection element, wherein the first radiation element and the second radiation element substantially extend in opposite directions; and a shorting element, wherein the feeding connection element is coupled through the shorting element to a ground voltage; and a floating radiation element, disposed adjacent to the first radiation element and the second radiation element, and configured to enhance radiation efficiency of the antenna structure;

wherein the frame is at least partially made of a nonconductive material, and the housing is at least partially made of a conductive material;

wherein the antenna structure has a first vertical projection on the housing, the first vertical projection is inside the parallel region, the floating radiation element has a second vertical projection on the housing, and the second vertical projection is inside the cutting retraction region.

2. The mobile device as claimed in claim 1, wherein the housing has a structural the parallel region and the cutting retraction region, such that the parallel region and the cutting retraction region have different extending planes.

3. The mobile device as claimed in claim 1, wherein a first average distance is defined between the frame and the parallel region, a second average distance is defined between the frame and the cutting retraction region, and the second average distance is shorter than the first average distance.

4. The mobile device as claimed in claim 1, wherein a first coupling gap is formed between the floating radiation element and the first radiation element, a second coupling gap is formed between the floating radiation element and the second radiation element, a width of the first coupling gap is from 0.1 mm to 1 mm, and a width of the second coupling gap is from 0.1 mm to 1 mm.

5. The mobile device as claimed in claim 1, wherein a width of the floating radiation element is from 2 mm to 3 mm.

6. The mobile device as claimed in claim 1, wherein the antenna structure covers a first frequency band from 2400 MHz to 2500 MHz, and a second frequency band from 5150 MHz to 5850 MHz.

7. The mobile device as claimed in claim 6, wherein a total length of the feeding connection element and the first radiation element is shorter than or equal to 0.25 wavelength of the first frequency band.

8. The mobile device as claimed in claim 6, wherein a total length of the feeding connection element and the second radiation element is shorter than or equal to 0.25 wavelength of the second frequency band.

9. The mobile device as claimed in claim 1, wherein a length of the shorting element is substantially equal to a length of the second radiation element.

10. The mobile device as claimed in claim 1, wherein a length of the floating radiation element is substantially equal to a sum of a half of a length of the first radiation element and a length of the second radiation element.

11. A mobile device, comprising:

a body, comprising a frame and a housing, wherein the frame is positioned on a first plane, the housing comprises a parallel region and a cutting retraction region, the parallel region is positioned on a second plane, and the second plane is parallel to the first plane;

an antenna structure; and a floating radiation element, disposed adjacent to the antenna structure, and configured to enhance radiation efficiency of the antenna structure;

wherein the frame is at least partially made of a nonconductive material, and the housing is at least partially made of a conductive material;

wherein the antenna structure has a first vertical projection on the housing, the first vertical projection is inside the parallel region, the floating radiation element has a second vertical projection on the housing, and the second vertical projection is inside the cutting retraction region.

12. The mobile device as claimed in claim 11, wherein the antenna structure comprises:

a feeding connection element, coupled to a signal source;

a first radiation element, coupled to the feeding connection element;

a second radiation element, coupled to the feeding connection element, wherein the first radiation element and the second radiation element substantially extend in opposite directions; and a shorting element, wherein the feeding connection element is coupled through the shorting element to a ground voltage.

13. The mobile device as claimed in claim 11, wherein the housing has a structural bending portion, and the structural bending portion of the housing is positioned between the parallel region and the cutting retraction region, such that the parallel region and the cutting retraction region have different extending planes.

14. The mobile device as claimed in claim 11, wherein a first average distance is defined between the frame and the parallel region, a second average distance is defined between the frame and the cutting retraction region, and the second average distance is shorter than the first average distance.

15. The mobile device as claimed in claim 12, wherein a first coupling gap is formed between the floating radiation element and the first radiation element, a second coupling gap is formed between the floating radiation element and the second radiation element, a width of the first coupling gap is from 0.1 mm to 1 mm, and a width of the second coupling gap is from 0.1 mm to 1 mm.

16. The mobile device as claimed in claim 12, wherein the antenna structure covers a first frequency band from 2400 MHz to 2500 MHz, and a second frequency band from 5150 MHz to 5850 MHz.

17. The mobile device as claimed in claim 16, wherein a total length of the feeding connection element and the first radiation element is shorter than or equal to 0.25 wavelength of the first frequency band.

18. The mobile device as claimed in claim 16, wherein a total length of the feeding connection element and the second radiation element is shorter than or equal to 0.25 wavelength of the second frequency band.

19. The mobile device as claimed in claim 12, wherein a length of the shorting element is substantially equal to a length of the second radiation element.

20. The mobile device as claimed in claim 12, wherein a length of the floating radiation element is substantially equal to a sum of a half of a length of the first radiation element and a length of the second radiation element.

* * * * *